US009812816B2

(12) United States Patent
Imai et al.

(10) Patent No.: US 9,812,816 B2
(45) Date of Patent: Nov. 7, 2017

(54) CONNECTOR FOR USE WITH A SOCKET

(71) Applicant: HORIZON CO., LTD., Azumino-shi, Nagano (JP)

(72) Inventors: Kiyotaka Imai, Nagano (JP); Yoichiro Hijikuro, Tokyo (JP)

(73) Assignee: HORIZON CO., LTD., Nagano (JP)

( * ) Notice: Subject to any disclaimer, the term of this patent is extended or adjusted under 35 U.S.C. 154(b) by 0 days.

(21) Appl. No.: 15/120,878

(22) PCT Filed: Jul. 30, 2014

(86) PCT No.: PCT/JP2014/070025

§ 371 (c)(1),
(2) Date: Aug. 23, 2016

(87) PCT Pub. No.: WO2015/159446

PCT Pub. Date: Oct. 22, 2015

(65) Prior Publication Data

US 2017/0033504 A1 Feb. 2, 2017

(30) Foreign Application Priority Data

Apr. 18, 2014 (JP) ..... 2014-002045

(51) Int. Cl.
*H01R 24/60* (2011.01)
*H01R 13/6581* (2011.01)
(Continued)

(52) U.S. Cl.
CPC ..... *H01R 13/6581* (2013.01); *H01R 13/405* (2013.01); *H01R 13/6597* (2013.01);
(Continued)

(58) Field of Classification Search
CPC ..... H01R 24/78; H01R 23/02; H01R 24/60
(Continued)

(56) References Cited

U.S. PATENT DOCUMENTS 4,298,237 A * 11/1981 Griffith ..... H05K 1/117 439/60
8,109,795 B2 * 2/2012 Lin ..... H01R 13/6461 439/660
(Continued)

FOREIGN PATENT DOCUMENTS

JP 09017512 A 1/1997
JP 2010140775 A 6/2010
(Continued)

OTHER PUBLICATIONS

International Search Report corresponding to Application No. PCT/JP2014/070025; dated Sep. 30, 2014.

*Primary Examiner* — Neil Abrams
(74) *Attorney, Agent, or Firm* — Cantor Colburn LLP

(57) ABSTRACT

A connector comprises: contacts disposed in a row so as to be mutually parallel; a metal case that comprises one surface which is parallel to the direction of disposition of the contacts and two surfaces which are perpendicular with respect to the direction of disposition of the contacts and sandwich the ends of the disposition of the contacts, and that arranged while kept from contact with the contacts; and a synthetic-resin insulator that is formed so as to encase the contacts and the metal case and that exposes part of the contacts and part of the metal case as external contact points.

2 Claims, 6 Drawing Sheets

(51) Int. Cl.

| | |
|---|---|
| ***H01R 13/6597*** | (2011.01) |
| ***H01R 24/64*** | (2011.01) |
| ***H01R 13/405*** | (2006.01) |
| ***H01R 24/62*** | (2011.01) |
| ***H01R 43/24*** | (2006.01) |
| *H01R 107/00* | (2006.01) |

(52) U.S. Cl.
CPC ..... *H01R 24/62* (2013.01); *H01R 24/64* (2013.01); *H01R 43/24* (2013.01); *H01R 2107/00* (2013.01)

(58) Field of Classification Search
USPC ..... 439/607.08, 607.11, 660
See application file for complete search history.

(56) References Cited

U.S. PATENT DOCUMENTS 8,221,163 B2 * 7/2012 Kawakami ..... H01R 13/6473 439/607.13
8,461,465 B2 * 6/2013 Golko ..... H01R 13/516 174/359
8,517,766 B2 * 8/2013 Golko ..... H01R 13/516 439/607.41
8,777,666 B2 * 7/2014 Golko ..... H01R 13/6594 439/607.34
8,794,981 B1 * 8/2014 Rodriguez ..... H01R 13/405 439/606
8,851,927 B2 * 10/2014 Hsu ..... H01R 12/724 439/607.11
8,905,793 B2 * 12/2014 Golko ..... B29C 45/14655 439/660
8,911,260 B2 * 12/2014 Golko ..... H01R 13/6581 439/108
8,911,262 B1 * 12/2014 Leiba ..... H01R 24/60 439/660
8,968,031 B2 * 3/2015 Simmel ..... H01R 13/659 439/108
9,011,172 B2 * 4/2015 Weber ..... H01R 43/26 439/358
9,011,179 B2 * 4/2015 Siahaan ..... H01R 13/504 439/606
9,059,531 B2 * 6/2015 Schmidt ..... H01R 13/6581
9,093,803 B2 * 7/2015 SooHoo ..... G06F 1/1626
9,153,926 B2 * 10/2015 Wu ..... H01R 13/6585
9,231,356 B1 * 1/2016 Ju ..... H01R 24/78
9,325,097 B2 * 4/2016 Do
9,431,746 B2 * 8/2016 Wu ..... H01R 13/443
9,431,772 B2 * 8/2016 Gao ..... H01R 13/6597
9,431,774 B2 * 8/2016 Shih ..... H05K 5/0069
9,450,339 B2 * 9/2016 Gao ..... H01R 13/6582
9,450,355 B2 * 9/2016 Zhang ..... H01R 13/6581
9,466,929 B2 * 10/2016 Wu ..... H01R 24/60
9,502,841 B2 * 11/2016 Little ..... H01R 4/023
9,525,227 B2 * 12/2016 Little ..... H01R 13/6273
9,627,815 B2 * 4/2017 Wu ..... H01R 13/6581
9,640,885 B2 * 5/2017 Amini ..... H01R 12/73
2011/0294349 A1 12/2011 Kawakami et al.
2015/0244111 A1 * 8/2015 Ju ..... H01R 13/6585 439/607.05
2016/0064869 A1 * 3/2016 Yu ..... H01R 24/60 439/607.05
2017/0033504 A1 * 2/2017 Imai ..... H01R 13/6581

FOREIGN PATENT DOCUMENTS

JP 2011253667 A 12/2011
JP 2013532351 A 8/2013
WO 2011150403 A1 12/2011

* cited by examiner

CONNECTOR FOR USE WITH A SOCKET

This is the U.S. national stage of application No. PCT/JP2014/070025, filed on Jul. 30, 2014. Priority under 35 U.S.C. §119(a) and 35 U.S.C. §365(b) is claimed from Japanese Application No. 2014-002045, filed Apr. 18, 2014, the disclosure of which is also incorporated herein by reference.

TECHNICAL FIELD

The present invention relates to a connector.

BACKGROUND ART

In order to connect devices such as a smart phone, a tablet PC, an audio player and the like to a USB (Universal Serial Bus) of a personal computer, there is required a connection cable establishing a connection between the smart phone, tablet PC or audio player side and the USB on the personal computer side. A connector disclosed in PTL 1 is an example of a connector on the smart phone, tablet PC or audio player side.

The connector disclosed in PTL 1 uses a U-shaped or cap-shaped metal frame, which allows for discharge with a contact of a drain wire of a board-side connector on the smart phone, tablet PC or audio player as well as grounding with a lock fitting.

CITATION LIST

Patent Literature

{PTL 1}: JP 2013-532351 A

SUMMARY OF INVENTION

Technical Problem

The connector disclosed in PTL 1 uses a special metal frame that is U-shaped or cap-shaped. This results in the need to manufacture an expensive mold and an increase in production costs.

The present invention has been made against such background, where an object of the present invention is to provide, at low cost, a connector that can be used while inserted into a board-side connector into which the patented connector disclosed in PTL 1 is inserted.

Solution to Problem

The present invention is a connector including: a plurality of contacts arranged in a line to be parallel with one another; a metal case arranged while kept from contact with the plurality of contacts, and including one surface parallel to a direction in which the plurality of contacts is arranged and two surfaces perpendicular to the direction in which the contacts are arranged also sandwiching both ends of the arrangement of the contacts; and an insulator which is made of synthetic resin, formed so as to contain the plurality of contacts and the metal case, wherein a part of the contacts and a part of the metal case are exposed from the insulator to the outside.

Moreover, according to the connector of the present invention, it is preferred in addition to the aforementioned configuration that the insulator be formed into the shape of a plate including substantially rectangular upper surface and lower surface, and a side surface between the upper surface and the lower surface, and that a part of the contact be exposed on either one of the upper surface and the lower surface while a part of an external contact of the metal case be exposed on the side surface between longer sides of the rectangle. It is also preferred to include an external contact for a contact of a drain wire. It is preferred that the external contacts are arranged so as to sandwich both ends of the arrangement of the contacts on either one of the upper surface and the lower surface.

Furthermore, according to the connector of the present invention, it is preferred that a surface of the insulator on a side having the exposed portion of the contact include a plurality of grooves having a predetermined depth and arranged in a line to be parallel with one another in addition to any of the aforementioned configurations. It is preferred that the each groove is formed in spacing between the contacts adjacent to each other.

Advantageous Effects of Invention

According to the present invention, there can be provided at low cost the connector that can be used while inserted into the board-side connector into which the connector disclosed in PTL 1 is inserted.

DESCRIPTION OF EMBODIMENTS

Figure 1:
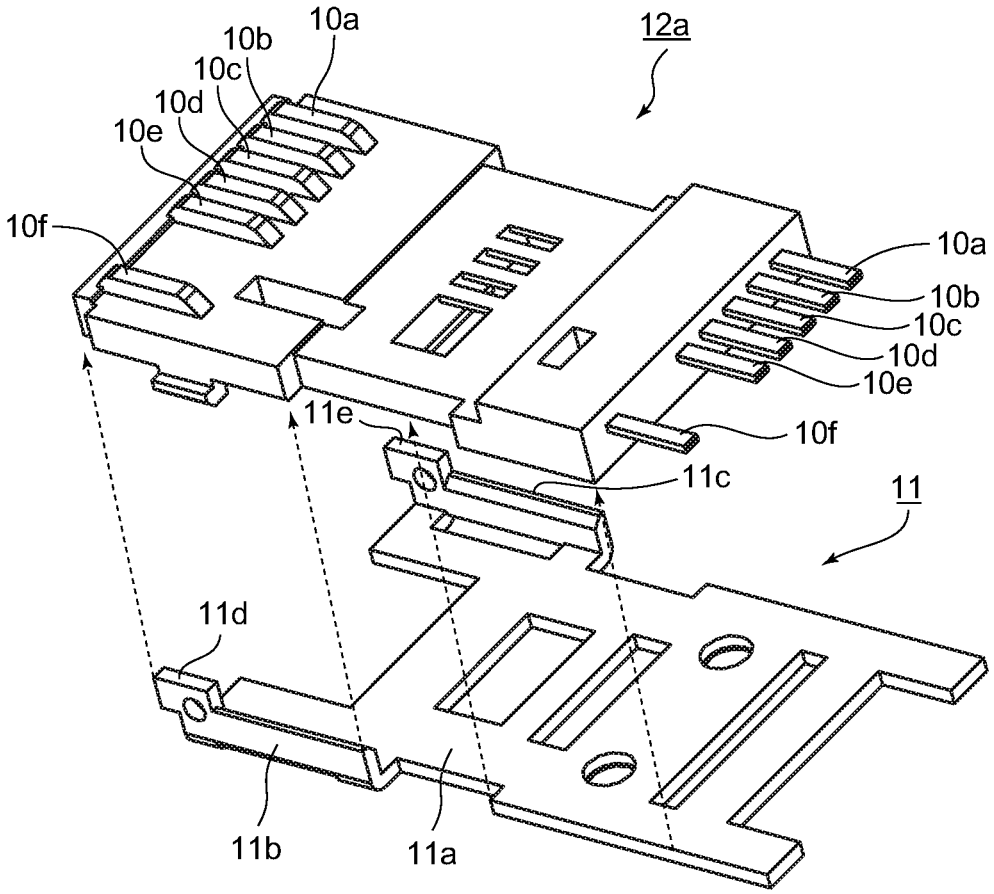
FIG. 1 is a diagram illustrating a manufacturing process of a connector 1 of the present invention, namely a state in which a metal case 11 is to be attached to an insulator 12*a* including a contact.
Figure 2:
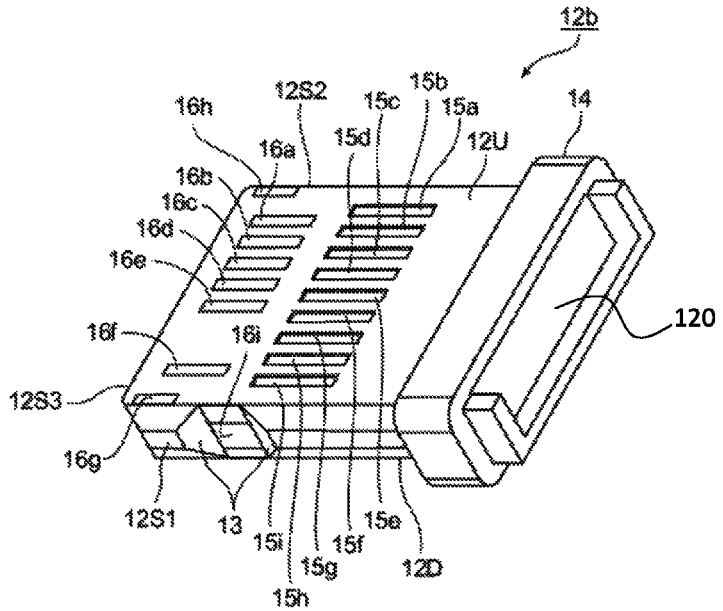
FIG. 2 is a diagram illustrating an insulator 12*b* that covers the insulator 12*a* and the metal case 11 in FIG. 1 after completing the manufacturing process in FIG. 1.
Figure 3:
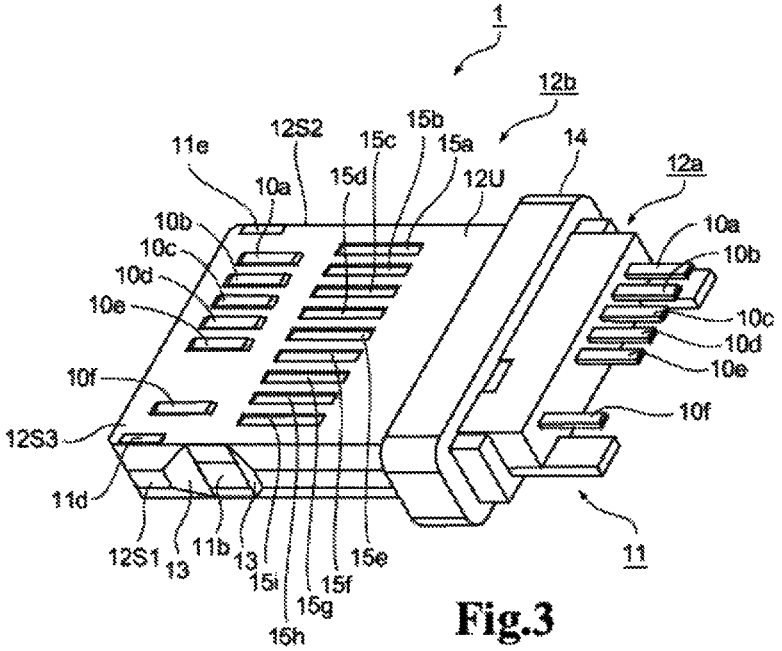
FIG. 3 is a diagram illustrating a state in which the whole the manufacturing process is completed, namely a state in which the insulator 12*b* in FIG. 2 covers the insulator 12*a* and the metal case 11 after completing the manufacturing process in FIG. 1.

A connector 1 of the present invention includes, as illustrated in FIG. 1, a plurality of contacts 10*a*, 10*b*, 10*c*,

10*d*, 10*e*, and 10*f* arranged in a line to be parallel with one another and a metal case 11 arranged while kept from contact with the contacts 10*a* to 10*f*. The metal case 11 including one surface 11*a*, i.e., a first metal plate 11*a*, parallel with a direction in which the contacts 10*a* to 10*f* are arranged and two surfaces 11*b* and 11*c*, i.e., first side plate 11*b* and second side plate 11*c*, perpendicular to the direction in which the contacts 10*a* to 10*f* are arranged also sandwiching both ends of the arrangement of the contacts 10*a* to 10*f*. In other words, first side plate 11*b* and second side plate 11*c* extend from first metal plate 11*a* in a direction substantially perpendicular to a surface of the first metal plate. Moreover, as illustrated in FIGS. 2 and 3, the connector 1 includes insulators 12*a* (i.e., first insulator 12*a*) and 12*b* (i.e., second insulator 12*b*), which are made of synthetic resin and formed so as to contain the contacts 10*a* to 10*f* and the metal case 11. A part of the contacts 10*a* to 10*f* and a part of the metal case 11 are exposed from insulators 12*a* and 12*b* as external contacts.

As illustrated in FIG. 2, the insulator 12*b* is formed into the shape of a plate including substantially rectangular upper surface 12U and lower surface 12D, and side surfaces 12S1, 12S2, and 12S3 between the upper surface 12U and the lower surface 12D, thereby defining an internal space 120.

A part of the insulator 12*a* and a part of the metal case 11 is exposed from the insulator 12*b* illustrated in FIG. 2. Specifically, the part of the contacts 10*a* to 10*f* are exposed on the upper surface 12U as illustrated in FIG. 3 through holes 16*a*, 16*b*, 16*c*, 16*d*, 16*e*, and 16*f* illustrated in FIG. 2. Moreover, apart of the surface 11*b* of the metal case 11 is exposed through a hole 16*i* illustrated in FIG. 2. Note that a part of the surface 11*c* is also exposed through a hole (not shown) formed on the side surface opposite to the side of the hole 16*i*. Furthermore, a part of a surface 11*d* and a part of a surface 11*e* of the metal case 11 is exposed through holes 16*g* and 16*h* in FIG. 2, respectively. Note that while the insulator 12*b* in FIGS. 2 and 3 includes a protrusion 14, the protrusion 14 may be omitted as it is used to apply force when placing the insulator 12*b* in a process in which the insulator 12*b* is placed as illustrated in FIG. 3 on the insulator 12*a* and the metal case 11 that are in a state illustrated in FIG. 1.

Furthermore, as illustrated in FIGS. 2 and 3, each of grooves 15*a*, 15*b*, 15*c*, 15*d*, 15*e*, 15*f*, 15*g*, 15*h*, and 15*i* having a predetermined depth is formed at a position corresponding to spacing between the adjacent contacts 10*a* to 10*f* on the surface of the insulator 12*b* corresponding to the side including the exposed portions of the contacts 10*a* to 10*f*.

Figure 4A:
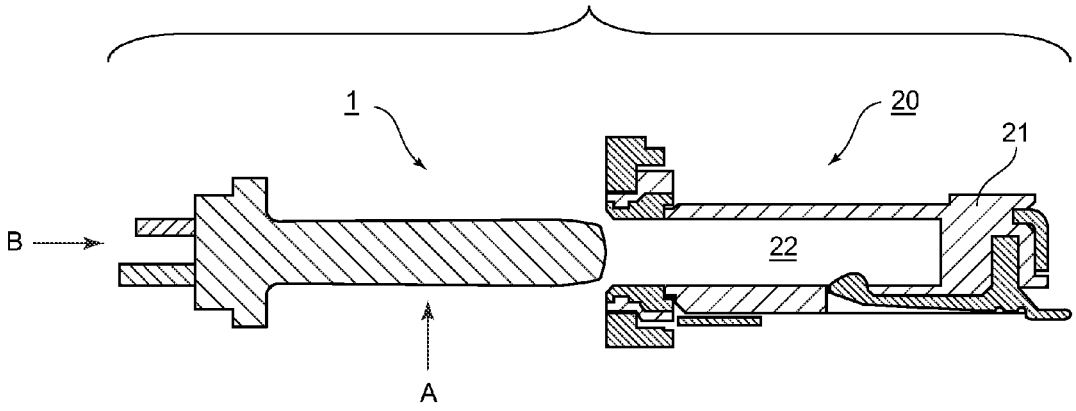
FIG. 4A is a diagram illustrating a cross section taken in a direction orthogonal to a contact exposed surface of the connector 1 when the connector 1 in FIG. 3 and a board-side connector 20 into which the connector 1 is inserted are to be connected together.
Figure 4B:
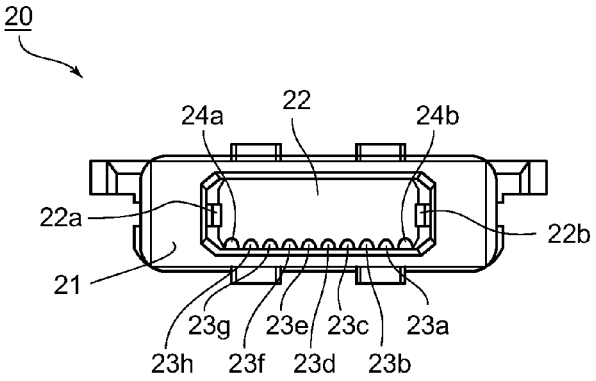
FIG. 4B is a diagram illustrating the front of an insertion port 22 of the board-side connector 20.
Figure 5A:
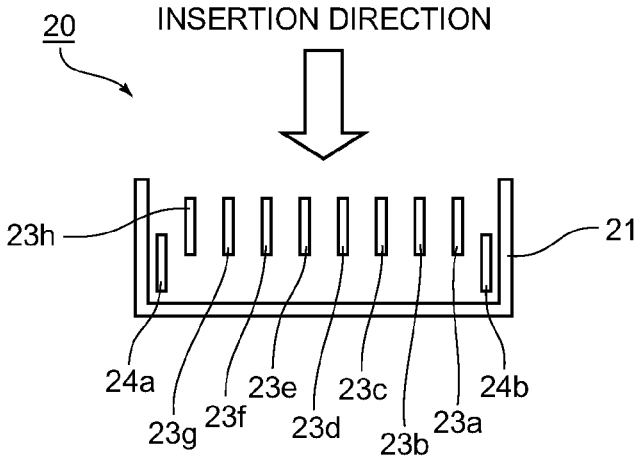
FIG. 5A is a diagram illustrating a terminal configuration of the board-side connector 20 in FIG. 4A.
Figure 5B:
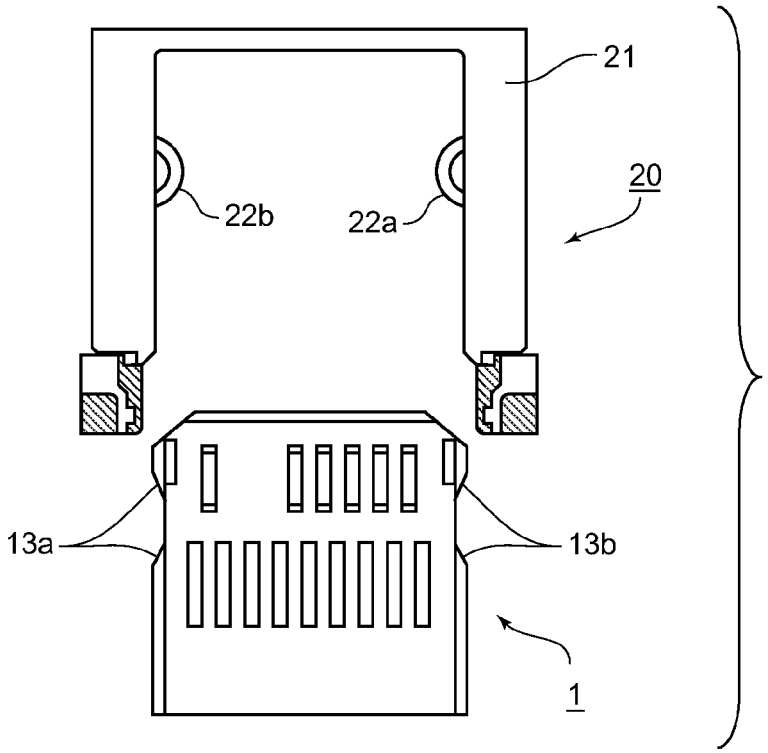
FIG. 5B is a diagram illustrating the connector 1 as viewed from a direction indicated with A in the FIG. 4A, and the board-side connector 20 from which a bottom surface of the insertion port 22 is omitted, in other words, the cross section being taken in a connection direction (direction indicated with B in the FIG. 4A) of the board-side connector 20.

Next, a method of connecting the connector 1 to a board-side connector 20 will be described with reference to FIGS. 4 and 5. FIG. 4A is a diagram illustrating a cross section taken in a direction orthogonal to a contact exposed surface of the connector 1 when the connector 1 in FIG. 3 and the board-side connector 20 into which the connector 1 is inserted are to be connected together. FIG. 4B is a diagram illustrating the front of an insertion port of the board-side connector 20. FIG. 5A is a diagram illustrating a terminal configuration of the board-side connector 20 in FIG. 4A. FIG. 5B is a diagram illustrating the connector 1 as viewed from a direction indicated with A in FIG. 4A, and the board-side connector 20 from which a bottom surface of the insertion port 22 is omitted, in other words, the cross section being taken in a connection direction (direction indicated with B in FIG. 4A) of the board-side connector 20.

As illustrated in FIGS. 4 and 5, the board-side connector 20 includes a connector reception part 21, holding structures 22*a* and 22*b*, contacts of a drain wire 24*a* and 24*b* and other contacts 23*a*, 23*b*, 23*c*, 23*d*, 23*e*, 23*f*, 23*g*, and 23*h*. Note that the contact exposed surface of the connector 1 corresponds to the A direction side in FIG. 4, while the contacts of the drain wire 24*a* and 24*b* and the other contacts 23*a*, 23*b*, 23*c*, 23*d*, 23*e*, 23*f*, 23*g*, and 23*h* are formed on a bottom surface of the connector reception part 21 of the board-side connector 20.

When the connector 1 is inserted into the insertion port 22 of the connector reception part 21 of the board-side connector 20, notch portions 13*a* and 13*b* formed in the insulator 12*b* are fitted to the holding structures 22*a* and 22*b*. A certain amount of force is thus required to remove the connector 1 from the connector reception part 21 of the board-side connector 20. Moreover, the holding structures 22*a* and 22*b*, which also serve as ground contacts, of the board-side connector 20 are electrically connected to the surfaces 11*b* and 11*c* of the metal case 11 of the connector 1. Furthermore, when the connector 1 is inserted into the insertion port 22 of the connector reception part 21 of the board-side connector 20, the contacts of the drain wire 24*a* and 24*b* are electrically connected to a part (an area exposed on the insulator 12*b*) of each of the surfaces 11*d* and 11*e* of the metal case 11.

According to the connector 1, as described above, a metal frame requiring die molding as in PTL 1 is not used so that the connector 1 can be manufactured at low cost. Moreover, the exposure of a metal portion is kept at the minimum required so that corrosion, damage and dirt on the metal portion (that is, the portion serving as the contact and external contact) can be reduced. Furthermore, the grooves 15*a* to 15*i* having the predetermined depth are formed at the positions corresponding to the spacings between the adjacent contacts 10*a* to 10*f*, so that the grooves 15*a* to 15*i* can catch fine dirt and liquid entering while the connector 1 is inserted into the board-side connector 20 to be able to prevent the fine dirt and liquid from reaching the contacts 10*a* to 10*f*. Furthermore, the surfaces 11*b* and 11*c* can also act as a mechanism of protection for the metal case 11 and the insulator 12*a*. Furthermore, the surfaces 11*d* and 11*e* of the metal case 11 exposed on the surface of the upper surface 12U are configured to function as external contacts for the contact of the drain wire of the board-side connector 20.

Another Embodiment

The aforementioned embodiment can be modified in various ways without departing from the gist thereof. While there has been described to realize the state illustrated in FIG. 3 by placing the insulator 12*b* illustrated in FIG. 2 on the insulator 12*a* and the metal case 11 illustrated in FIG. 1, the state illustrated in FIG. 3 may be molded integrally, for example. In this case, the protrusion 14 can be omitted as it is used to apply force when placing the insulator 12*b* in the process in which the insulator 12*b* is placed as illustrated in FIG. 3 on the insulator 12*a* and the metal case 11 that are in the state illustrated in FIG. 1.

Figure 6:
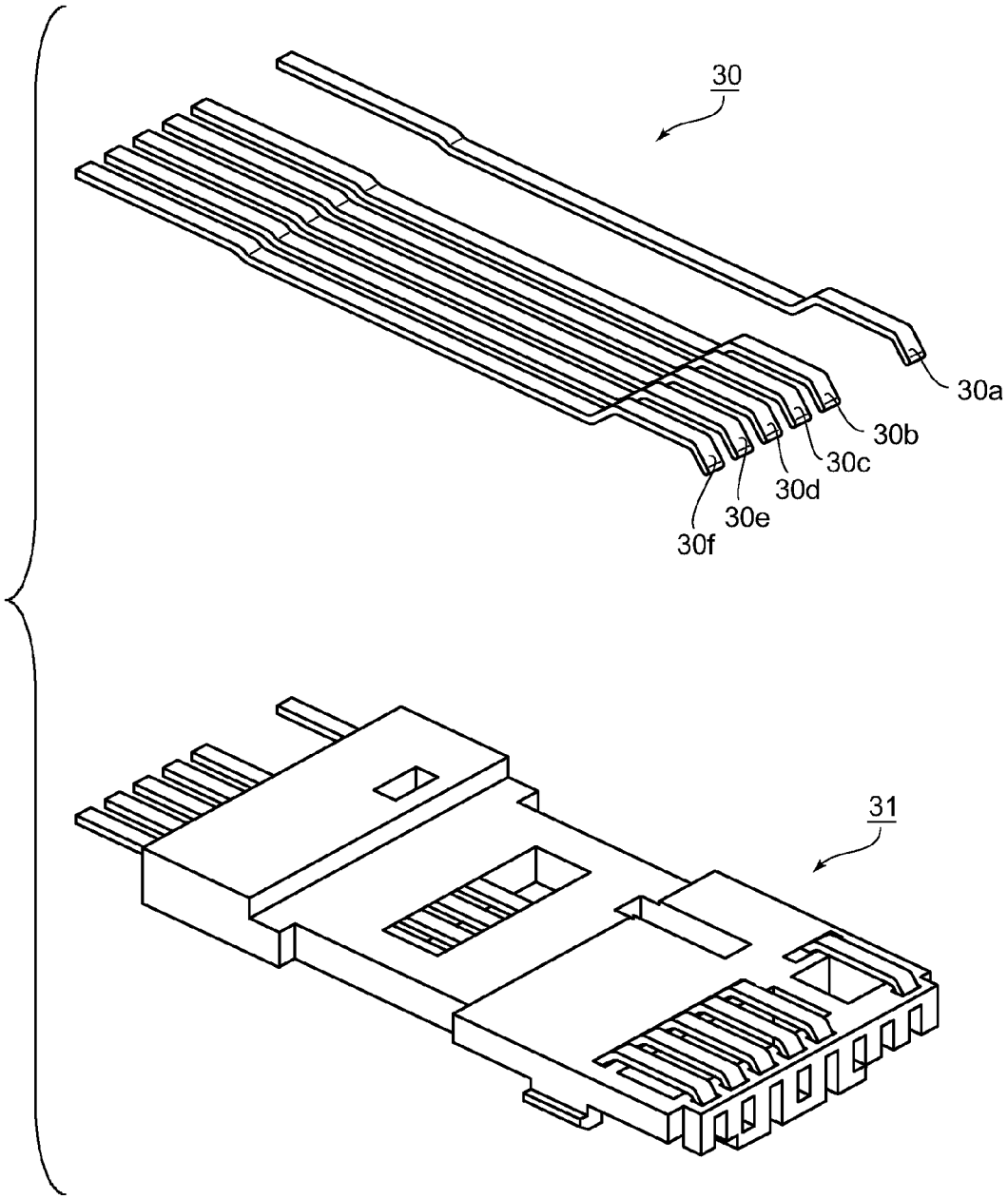
FIG. 6 is a pair of diagrams used to explain a method of manufacturing a connector 1A according to another embodiment of the present invention.
Figure 7:
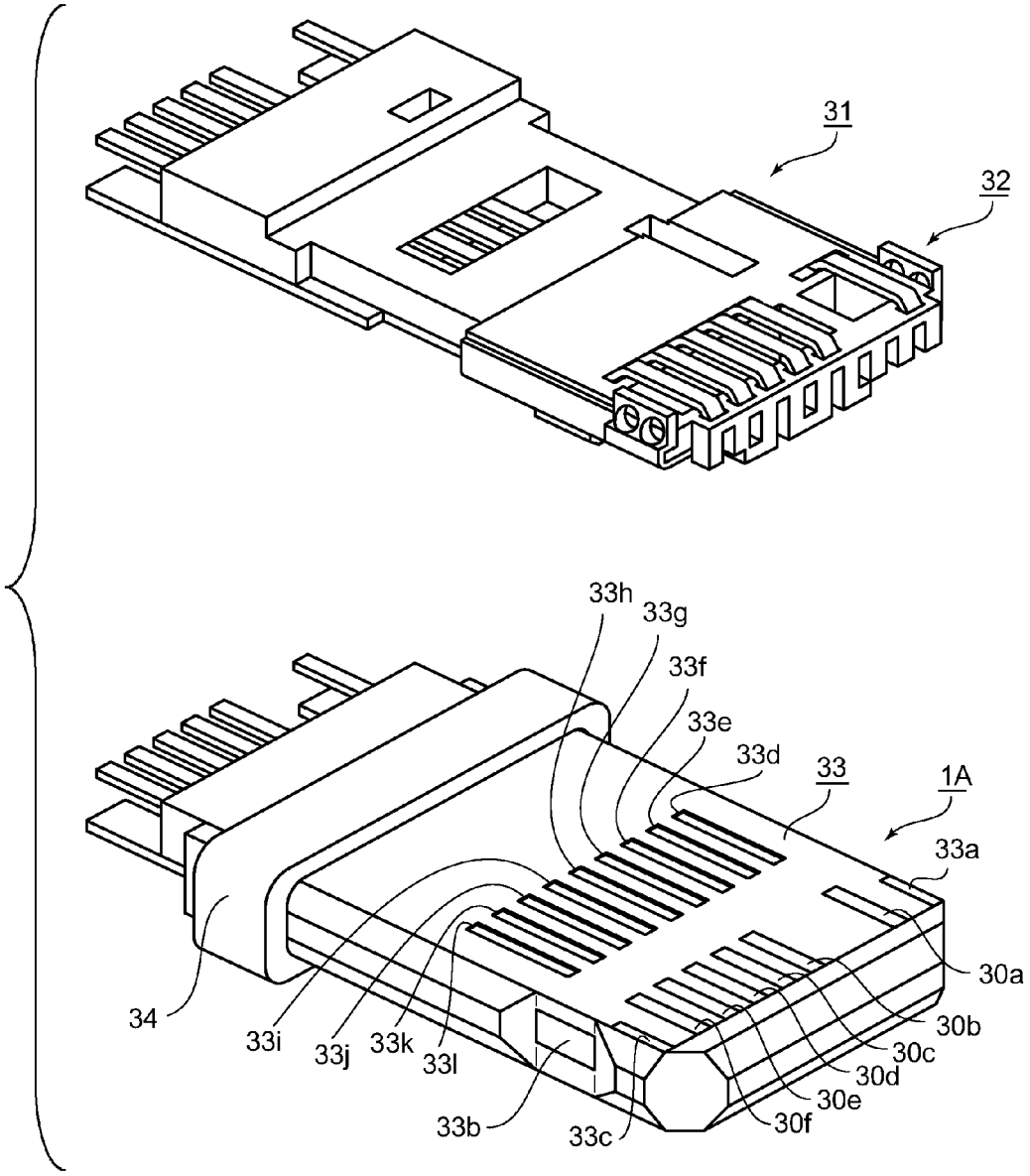
FIG. 7 is a pair of diagrams used to explain the method of manufacturing the connector 1A according to another embodiment of the present invention.

FIGS. 6 and 7 are diagrams used to explain the progress in a manufacturing process of a connector 1A according to another embodiment of the present invention. The connector 1A illustrated in a lower diagram in FIG. 7 is an example of a case where the connector is manufactured by integral molding. For example, an insulator 31 is formed by a special mold integrally with a lead 30 (leads 30*a*, 30*b*, 30*c*, 30*d*, 30*e*, and 30*f*) illustrated in an upper diagram in FIG. 6. Then, as illustrated in an upper diagram in FIG. 7, a metal case 32 is attached to a bottom surface of the insulator 31 that is manufactured by integral molding with the lead 30. Furthermore, as illustrated in a lower diagram in FIG. 7, an insulator 33 is formed by a special mold integrally with the insulator 31 to which the metal case 32 is attached, and fixed by a protrusion 34. Note that grooves 33*d*, 33*e*, 33*f*, 33*g*, 33*h*, 33*i*, 33*j*, 33*k*, and 331 are formed on the surface of the insulator 33. Moreover, the insulator 33 is molded such that a part of the aforementioned lead 30 (leads 30*a*, 30*b*, 30*c*, 30*d*, 30*e*, and 30*f*) is exposed on the surface of the insulator 33 as well as that a part of the metal case 32 (33*a*, 33*b*, 33*c* and an area corresponding to an opposite side of 33*b*, the area not being shown in the figure) is exposed on the surface of the insulator 33. The connector 1A manufactured by adopting such manufacturing method can achieve the effect similar to that achieved by the aforementioned connector 1.

Note that the number and arrangement of the contacts illustrated in FIGS. 1 to 7 above are one example and thus can be modified in various ways. Likewise, the number and arrangement of the grooves 15*a* to 15*i* and the grooves 33*d* to 331 illustrated in FIGS. 2, 3, 6, 7, and the like are one example and thus can be modified in various ways including a form not including a groove.

Moreover, the shape of the metal case 11 and the metal case 32 can be also modified in various ways as long as a part of the metal portion is exposed to function as the external contact for the contact of the drain wire of the board-side connector 20.

The invention claimed is:

1. A connector for use with a socket, the connector comprising:

a plurality of contacts;

a first insulator formed of a resin;

a metal case comprising:

a first metal plate having a longer dimension along a length direction; and a first side plate extending from the first metal plate in a direction substantially perpendicular to a surface of the first metal plate; and a second side plate extending from first metal plate in the direction substantially perpendicular to the surface of the first metal plate;

a second insulator formed of a resin, the second insulator comprising an interior space and being formed with through holes allowing communication between the interior space and a space exterior to the second insulator;

wherein the plurality of contacts are arranged to be mutually parallel and arranged so as to extend along the length direction;

wherein the plurality of contacts are arranged such that at least a portion of each of the plurality of contacts is embedded within the first insulator, and each of the plurality of contacts is exposed at first and second ends of the first insulator;

wherein the metal case is structured to couple with the first insulator such that the metal case does not touch any of the plurality of contacts;

wherein the second insulator is structured to accommodate the first insulator and the metal case coupled together within the interior space;

wherein the through holes of the second insulator are arranged such that the plurality of the contacts of the first insulator and the first side plate and the second side plate of the metal case are exposed to the space exterior to the second insulator.

2. The connector according to claim 1, wherein the second insulator is formed into the shape of a plate including a substantially rectangular upper surface and a substantially rectangular lower surface, and side surfaces between the upper surface and the lower surface, a part of the contact is exposed on either one of the upper surface and the lower surface, and a part of the metal case is exposed on the side surface between longer sides of the upper surface and the lower surface or exposed on either one of the substantially rectangular upper surface and lower surface so as to function as an external contact for a contact of a drain wire.

* * * * *